United States Patent [19]

Shimizu et al.

[11] 4,450,335

[45] May 22, 1984

[54] DOOR OPENING APPARATUS FOR HEATING APPLIANCE

[75] Inventors: Toshiki Shimizu; Kazuyuki Inoue, both of Osaka, Japan

[73] Assignee: Matsushita Electric Industrial Co., Ltd., Kadoma, Japan

[21] Appl. No.: 343,733

[22] Filed: Jan. 29, 1982

[30] Foreign Application Priority Data

Feb. 2, 1981 [JP] Japan ..... 56-14798

[51] Int. Cl.[3] ..... H05B 9/06

[52] U.S. Cl. ..... 219/10.55 C; 219/10.55 D

[58] Field of Search ..... 219/10.55 B, 10.55 C, 219/10.55 D, 514; 126/192; 110/178

[56] References Cited

U.S. PATENT DOCUMENTS

| | | | |
|---|---|---|---|
| 3,682,116 | 8/1972 | Spencer | 110/176 |
| 3,823,294 | 7/1974 | Takayama et al. | 219/10.55 D |
| 4,340,799 | 7/1982 | Ueda et al. | 219/10.55 C |

FOREIGN PATENT DOCUMENTS

| | | | |
|---|---|---|---|
| 980872 | 1/1965 | United Kingdom | 219/10.55 D |

*Primary Examiner*—Volodymyr Y. Mayewsky
*Assistant Examiner*—M. M. Lateef

[57] ABSTRACT

A door opening apparatus for a heating appliance in which a door for opening and closing a heating cavity may be automatically opened without it being touched. A plunger solenoid is used for unlocking the door and a foot switch is disposed outside of the appliance to activate the plunger in response to the depression thereof.

7 Claims, 7 Drawing Figures

DOOR OPENING APPARATUS FOR HEATING APPLIANCE

DESCRIPTION OF THE INVENTION

The present invention relates to a heating appliance which includes a housing having a heating cavity therein and a door supported on the housing to open and close the heating cavity, and more particularly relates to an improved heating appliance in which the door may be automatically opened without it being touched.

In the past, heating appliances having housings supporting doors were well known and included, for example, conventional electric ovens, gas ovens and microwave ovens. In those heating appliances, when a user desires to open the door to place a cooking object (food to be heated) into the heating cavity, he must necessarily use his hand to open the door. This has several disadvantages. For example, when both of a user's hands are occupied holding the cooking object to be heated, it is almost impossible to open the door. Furthermore, since the hands of a user are often dirty at the time of cooking, if such a user touches the door of the cooking appliance to open it, the door also becomes dirty and will require cleaning after the completion of cooking. From a safety point of view, for example in an electric heating appliance such as a microwave oven, if a user touches the door to open it with a hand which is wet, he may receive an electric shock from the appliance. However, if the door is automatically opened without the user touching the door with his hand, it will be very convenient and safe.

In the prior art field of microwave ovens, automatic door locking systems has been known, such as shown for example in U.S. Pat. No. 3,823,294 and British Pat. No. 980,872.

U.S. Pat. No.3,823,294 describes a door locking system which uses a plunger solenoid. When the door has been closed, the solenoid is energized to move its plunger; and, the plunger engages the door to keep the door in the closed position. Since the solenoid is only de-energized upon completion of cooking, the user cannot open the door freely during cooking. The solenoid can also be de-energized upon the cooking being stopped by the depression of an emergency stop switch, but the switch is disposed proximate the door and is operated only by the hand of the user.

British Pat. No. 980,872 describes a door locking system wherein the door is secured by the use of an electromagnet. When the door is closed, the electromagnet is energized to keep the door in a closed position until the energizing voltage is automatically cut off at the end of a predetermined heating period.

The present invention, therefore, has as its principal object the provision of an improved heating appliance in which the door to open and close the heating cavity may be automatically opened without it being touched.

Another object of the invention is to provide an improved heating appliance in which the door may be automatically opened in response to an actuation of a switch disposed outside of the heating appliance.

A further object of the invention is to provide an improved heating appliance in which the door may be opened automatically without touching it and the heating operation is automatically stopped in response to the opening of the door to prevent the occurance of a dangerous condition.

Still another object of the invention is to provide an improved heating appliance in which the door may be automatically opened without touching it and unnecessary energy consumption is eliminated after the door is opened.

According to the present invention as described herein, the following benefits, among others, are obtained:

(1) An improved heating appliance in which the door may be automatically opened without it being touched;

(2) An improved electric heating appliance in which the door may be automatically opened without touching it and the heating operation is automatically stopped when the door is opened; and (3) An improved heating appliance in which the door may be automatically opened without touching it and an unnecessary operation of a heating system is automatically stopped when the door is opened.

These and other objects are accomplished by an appliance according to the present invention, which appliance includes a housing having a heating cavity therein, a door supported on the housing for opening and closing the heating cavity, locking means for locking the door in its closed position, releasing means for releasing the locking operation of the locking means to unlock the door, and control means disposed outside of the housing for activating the releasing means in response to the operation of the control means.

In a first illustrative embodiment, the locking means includes at least one locking member disposed in the door and at least one engaging member disposed in the housing for engaging with the locking member to lock the door in its closed position. The releasing means includes at least one releasing member for releasing the engagement of the locking member and engaging member, and drive means for activating the releasing member in response to the operation of the control means. The drive means includes a plunger solenoid or a motor for activating the releasing member and a power supply circuit to supply power thereto. The control means includes a foot-operated switch connected to the drive means by wires or a wireless switch coupled to the drive means by radio waves.

In a second illustrative embodiment, safety means are provided for stopping the heating operation of the appliance when the door is opened. The safety means includes at least one safety switch to detect whether the door is opened or closed and to interrupt the energy for the heating opeation of the appliance when the door is opened.

In a third illustrative embodiment, detecting means are provided for stopping the operation of the drive means when the door is opened. The detecting means includes at least one monitoring switch to detect whether the door is opened or closed and to interrupt the energy of the drive means when the door is opened.

While the novel features of the invention are set forth with particularly in the appended claims, the invention, both as to organization and content, will be better understood and appreciated, along with other objects and features thereof, from the following detailed description taken in conjunction with the drawing, in which:

Figure 6:
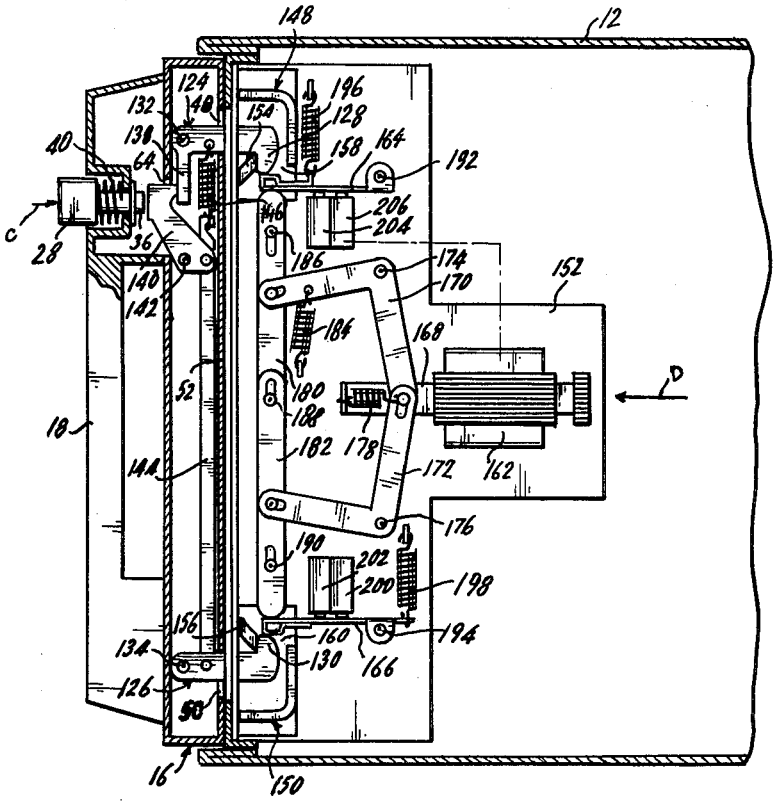
Figure 7:
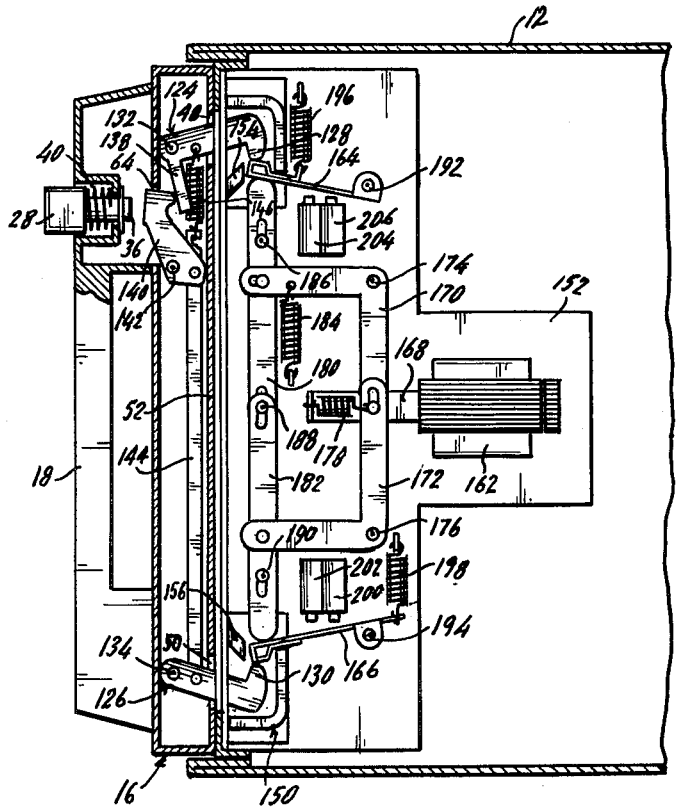

FIG. 6 is a fragmentary right-side section view of a microwave oven having an automatic door opening system of a second embodiment according to the subject invention and shows a stationary position of the automatic door opening system when the door is closed and locked; and FIG. 7 is a fragmentary right-side section view of the microwave oven of the second embodiment and shows an operated position of the automatic door opening system when the door is unlocked and ready to be opened.

Figure 1:
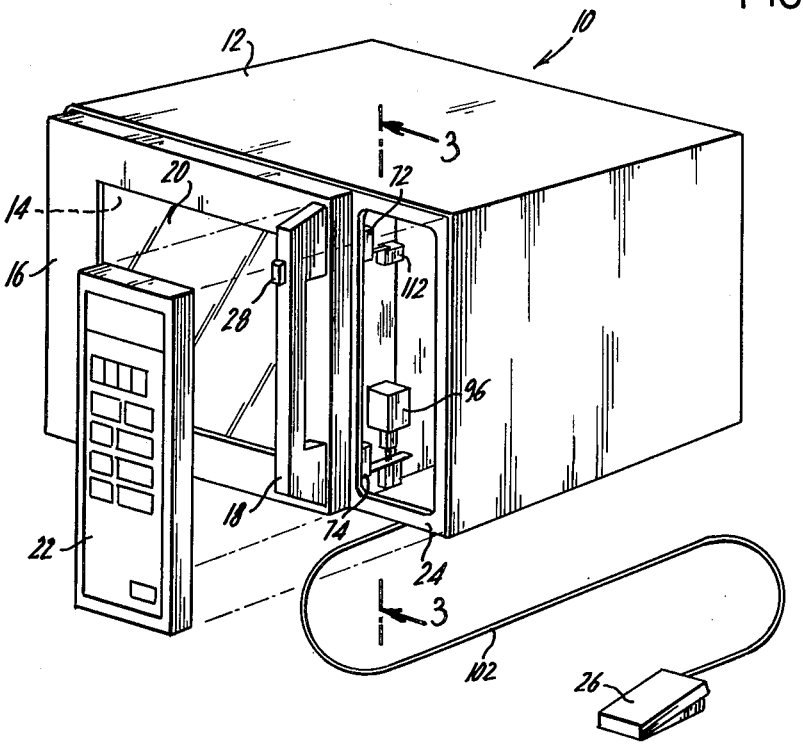
FIG. 1 is a reduced scale front perspective view of a microwave oven having an automatic door opening system of a first embodiment of the present invention.

Referring to the drawing and first to FIG. 1, there is illustrated a microwave oven, generally designated by the numeral 10, including an automatic door opening system constructed in accordance with and embodying the features of the first embodiment of the present invention. The oven 10 is a conventional microwave oven and includes a box-like housing 12, a cooking cavity 14 formed in the housing 12 for placing a cooking object (for example, food to be cooked) therein, and a front-opening access door 16 for opening and closing the cooking cavity 14, which door 16 is hingedly supported by conventional hinge straps (not shown) on the left end of the housing and is shown in FIG. 1 in its fully-closed position. The door 16 has a handle 18 arranged along the right end of the door 16, a transparent microwave shield window 20 through which the cooking object placed in the cavity 14 can be seen from the outside of the housing 12 without opening the door 16, and microwave sealing means (not shown) around the periphery of the door 16 to prevent the escape of microwave energy from the cooking cavity 14. The oven 10 is also provided with a magnetron for generating microwaves of a predetermined frequency, a transmission line for transmitting the microwave energy from the output of the magnetron to the cooking cavity 14 and a control box 22 mounted on the front right side of the oven 10 for providing control of the microwave oven cooking functions. The control box 22 is fixed on a front panel 24 of the housing by screws (not shown) and is shown in FIG. 1 detached from the housing 12 to illustrate the inner structure of the housing 12.

Figure 2:
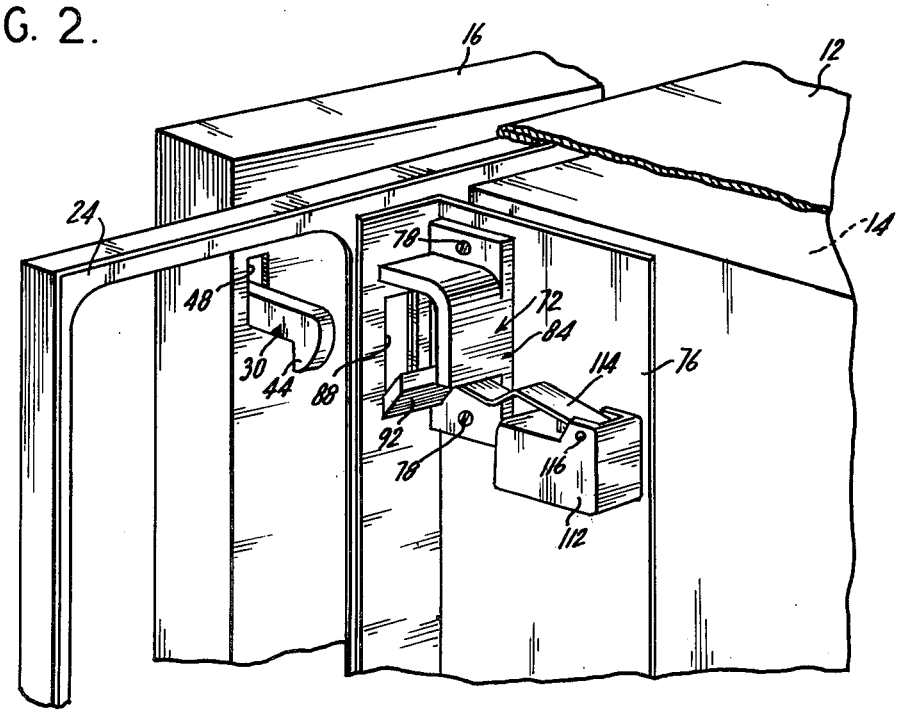
FIG. 2 is an enlarged, fragmentary rear perspective view showing a part of the door locking mechanism.
Figure 4:
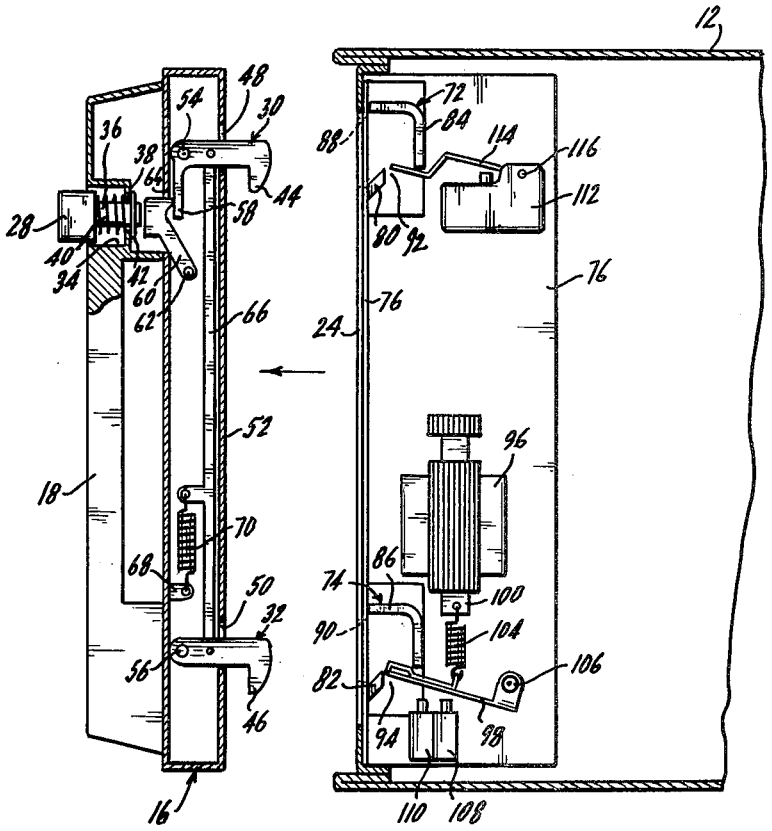
FIG. 4 is a fragmentary right-side section view of the oven of FIG. 1 similar to FIG. 3, and shows an operated position of the automatic door opening system.
Figure 3:
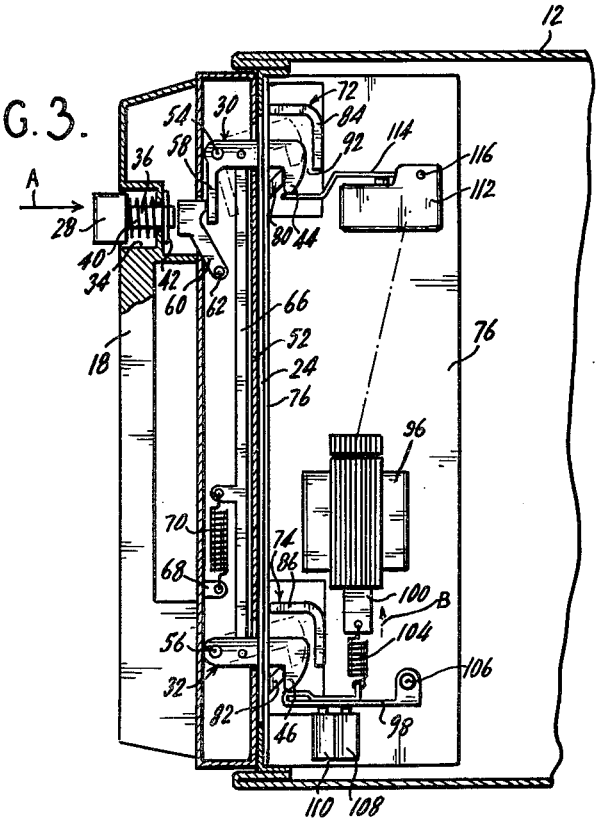
FIG. 3 is a fragmentary right-side section view of the oven taken along the line 3—3 of FIG. 1 and looking in the direction of the arrows and shows a stationary position of the automatic door opening system.

As stated above, the oven 10 according to the first embodiment of the invention includes an automatic door opening system. The system is operated so that the door 16 is automatically opened by, for example, pressing a foot switch 26 (FIG. 1) without touching the door 16. Referring now to FIGS. 2–4, constructional details of the automatic door opening system are shown as well as a door-locking mechanism and a manual door-opening mechanism. The door-locking and manual opening mechanisms will be first described. The door 16 has a door opening button 28 mounted movably in the handle 18 and hook-shape locking members 30, 32 mounted movably in the door 16. The button 28 is, as shown in FIG. 4, located movably in a recess 34 formed in the front surface of the handle 18 and has a shaft 36 penetrating a hole 38 formed in the bottom surface of the recess 34. Compression spring 40 is disposed around the shaft 36 and between the button 28 and the bottom surface of the recess 34 so that the button 28 extends from the handle 18. Stop ring 42 is attached to the end of the shaft 36 to aid in maintaining the button 28 in a predetermined extended position. The hook-shape locking members 30, 32 have downwardly directed hook portions 44, 46 extending through holes 48, 50 of a back plate 52 of the door 16 and bearing portions supported rotatably around support shafts 54, 56 which are fixed to the door 16. The first locking member 30 also has a rear depending portion 58, proximate which portion 58 a cantilever 60 is disposed. One end of the cantilever 60 is supported at its lower end for rotation around a support shaft 62 fixed to the door 16 and the other end of the cantilever 60 is disposed between the shaft 36 of the door opening button 28 and the depending portion 58 of the first locking member 30 protruding through a hole 64. Therefore, when the button 28 is pressed inwardly against the pressure of the spring 40, in the direction indicated by arrow A in FIG. 3, the cantilever 60 is pushed by the shaft 36 and rotated clockwise. The first locking member 30 is pushed by the rotated cantilever 60 and rotated counterclockwise so that the hook portion 44 is moved upward as indicated in phantom in FIG. 3.

The first locking member 30 is connected to the second locking member 32 by a link lever 66. The upper end of the link lever 66 is connected rotatably to the first locking member 30 by a pin and the lower end of the link lever 66 is connected rotatably to the second locking member 32 by a pin. Therefore, when the hook portion 44 of the first locking member 30 is moved upward in response to the actuation of the door opening button 28, as stated above, the second locking member 32 is pulled upward by the first locking member 30 through the link lever 66. The hook portion 46 of the second locking member 32 is moved upward (in the same direction as that of the hook portion 44 of the first locking member 30), as indicated in phantom in FIG. 3. The link lever 66 is coupled to a support plate 68, fixed on the inner surface of the door 16 by a tension spring 70. Spring 70 gives a downward-directed force on the link lever 66. Therefore, when the door opening button 28 is returned to its initial extended position by releasing a pressing force exerted thereon, the first and second locking members 30, 32 are also returned to their initial positions (FIG. 3) by the spring 70.

As shown in FIG. 3, when the door 16 is closed, the first and second locking members 30, 32 are engaged with first and second engaging members 72, 74 respectively to lock the door 16 in its closed position. Each of the engaging members 72, 74 is fixed on a support plate 76 by screws 78, as shown in FIG. 2, which support plate 76 is fixed in the housing 12. The engaging members 72, 74 have upwardly slanted engaging portions 80, 82 adapted to be engaged with the hook portions 44, 46 of the locking members 30, 32 and shield portions 84, 86 to shield holes 88, 90 formed in the front panel 24 of the housing 12 and the support plate 76. The holes 88, 90 permit the intrusion of the locking members 30, 32 and the shield portions 84, 86 prevent the escape of microwaves through the holes. Openings 92, 94 are formed between the engaging portions 80, 82 and the cover portions 84, 86 for permitting the intrusion of the hook portions 44, 46 of the locking members 30, 32. As is apparent from the foregoing, the engaging members 72, 74 and locking members 30, 32 are included in the door locking mechanism and the door opening button 28 and levers 60, 66 are included in the manual door opening mechanism. When the door 16 is pushed to close the cooking cavity 14, the locking members 30, 32 intrude into the housing 12 through the holes 88, 90 and the hook portions 44, 46 are moved upward along the slanted upper surfaces of the engaging portions 80, 82 of the engaging members 72, 74 and, finally, the hook portions 44, 46 are moved downward by the spring 70 to be engaged with the engaging portions 80, 82 through the openings 92, 94. By this operation, the door 16 is locked in its fully-closed position. When the door opening button 28 is pressed to open the door 16, as stated above, the locking members 30, 32 are moved upward to the position shown in phantom in FIG. 3 and the engagement of the locking members 30, 32 and engaging members 72, 74 is released. Thereafter, if the user pulls the handle 18 after pressing the button 28 fully inward, the door 16 can be opened.

As stated above, the appliance further includes an automatic door opening system. The system includes, for example, a foot switch 26 (FIG. 1), a plunger solenoid 96 and a movable member 98, and is constructed so that when the foot switch 26 is pressed, the solenoid 96 is energized to move the movable member 98 which then operates to release the engagement of the locking members 32, 30 and the engaging members 74, 72 to unlock the door. The automatic system also includes safety means for stopping the generation of microwaves when the door is opened and automatic stopping means for automatically de-energizing the solenoid 96 when the door 16 is opened, even if the foot switch 26 is pressed repeatedly after the door 16 is opened.

Figure 5:
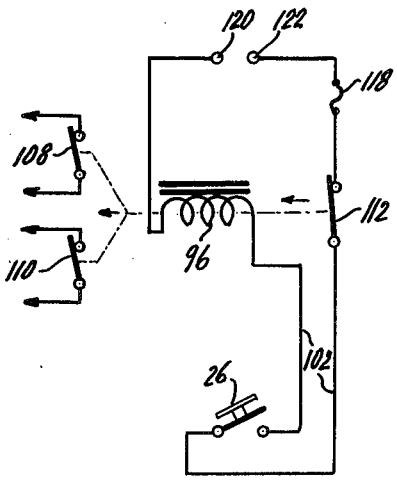
FIG. 5 is a schematic circuit diagram of one example of circuitry which may be used in the automatic door opening system.

Referring now to FIGS. 3, 4 and 5, the system will be described in detail. A pull-type plunger solenoid 96 is mounted on the support plate 76. The solenoid 96 is energized to move its plunger 100 in the upward, pulling direction, shown by arrow B in FIG. 3, when the foot switch 26 is pressed. The foot switch 26, as shown in FIG. 1, is disposed outside the housing 12 of the microwave oven 10 and connected to a power supply circuit (shown schematically in FIG. 5) of the solenoid 96 via cable 102. The plunger 100 of the solenoid 96 is connected to a movable member 98 via a tension spring 104. One end of the movable member 98 is supported rotatably by a shaft 106 fixed to the support plate 76 and the other end of the movable member 98 confronts the hook portion 46 of the second, lowermost locking member 32 (see FIG. 3).

When the door 6 is locked in its closed position, if the foot switch 26 is pressed to open the door 16, the solenoid 96 is energized to move the plunger 100 upward as shown in FIG. 3 and the plunger 100 pulls the movable member 98 up to the position shown in FIG. 4. The movable member 98 moves the second locking member 32 upward to the position shown in phantom in FIG. 3 and the second locking member 32 moves the first locking member 30 upward to the position shown in phantom in FIG. 3 through the link lever 66. As a result, the engagement of the locking member 30, 32 and engaging members 72, 74 is released to unlock the door 16.

The housing 12 may be slightly tilted forward by any conventional means. For example, a rear end of the housing 12 may be positioned higher than the front end thereof by making the length of the front feet (not shown) of the oven 10 a lower height than the height of the rear feet (not shown) of the oven. The door 16 would then be permitted to swing into a fully open position when the locking members 30, 32 are disengaged from engaging members 72, 74; and the door 16 is automatically opened in response to the operation of the foot switch 26.

Alternately, to urge the door 16 into fully open position, springs may be used in a conventional manner in the door support mechanism for imparting additional force to move door 16 toward its open position instead of tilting the housing 12.

If the generation of microwaves is continued after the door 16 is opened, it is dangerous to the user. To eliminate the occurrence of such dangerous condition, the oven 10 has conventional microwave sealing means around the periphery of the door 16 as stated above, and also has safety means for automatically stopping the generation of microwaves when the door 16 is opened. The safety means includes two safety switches 108, 110 interlocked with each other, which switches are all used for interrupting a power supply to the magnetron and are provided pursuant to the Department of Health and Human Service and Underwriter's Laboratory standards. The safety switches 108, 110 are mounted on the support plate 76 proximate the movable member 98. When the door 16 is in the closed position, the safety switches 108,110 are pushed by the locking members 32 through the movable member 98 to a position where they are rendered conductive. In this situation, normal cooking operation by microwave energy is possible. On the other hand, when the door 16 is to be opened, the movable member 98 is moved into contact with the cover portion 86 of the engaging member 74 by the spring 104 and is positioned as shown in FIG. 4 away from the switches 108, 110. The switches 108, 110 are thereby moved to cut off energy of the magnetron and the microwave energy is automatically stopped even if the cooking operation was in progress right before the door 16 was opened. Therefore, the safety means enhances the degree of saftey of the microwave oven 10.

As stated above, the automatic stopping means, which automatically de-energizes the solenoid 96 when the door 16 is opened, is also shown in FIGS. 3, 4 and 5. The automatic stopping means includes a monitoring switch 112 for sensing whether the door 16 is in an open position or in a closed position. The switch 112 is mounted on the support plate 76 proximate the first engaging member 72 and has an actuator 114 which is rotatable around a pin 116 and normally biased upward by a compression spring (not shown) accommodated in the case of switch 112. When the door 16 is in the closed position, the actuator 114 is pushed by the locking member 30 to render the switch conductive. On the other hand, when the door 16 is opened, the actuator is in contact with the cover portion 84 of the engaging member 72 and is positioned as shown in FIG. 4 to render the switch 112 non-conductive. The switch 112 is inserted in the power supply circuit of the solenoid 96, as shown in FIG. 5. That is, a fuse 118, the monitoring switch 112, the foot switch 26, and the solenoid 96 are connected in series between A.C. power source terminals 120, 122. Therefore, the solenoid 96 is operable only when the switch 112 is closed (that is, when the door 16 is closed). Since the monitoring switch 112 discontinues operation of the solenoid 96 the moment door 16 is opened, power supply to the solenoid 96 is interrupted without unpleasant hum in response to opening of the door 16 even if the foot switch 26 is left depressed for a long period of time. Moreover, the solenoid 96 is prevented from operating when the door 16 is opened, which results in elimination of erroneous operation and is an improvement in durability. After the solenoid 96 is de-energized, the plunger 100 is returned to its initial position (FIG. 3) by the tension spring 104.

Large current flow will burn out the coil of the solenoid 96 or produce loud hum during operation of the solenoid 96 unless the plunger 100 is held in close proximity to a fixed core of the solenoid 96. These problems, which are caused by deviation of the dimension of the actuating lever, can be avoided by provision of the spring 104 between the plunger 100 and the movable member 98 which accommodates such deviation in the dimensions of various components. Furthermore, while very high impact is given upon operation of the solenoid 96, the provision of the spring 104 is also effective in alleviating such impact, protecting various components in the locking mechanisms and thus insuring improved durability.

In the above-described first embodiment, since the solenoid 96 is used for moving the second locking member 32, the door 16 may not be opened smoothly when the first locking member 30 is not moved smoothly, for example, by a breakdown in the functioning of the link lever 66. To eliminate such operation, a second embodiment is proposed. FIGS. 6 and 7 show the microwave oven of the second embodiment. Since the second-type microwave oven has the same basic structure as that of the first-type microwave oven, like reference numbers in FIGS. 6 and 7 denote like parts in FIGS. 1–5 and further explanation thereof is omitted. The second embodiment microwave oven also includes a door locking mechanism, a manual door opening mechanism and an automatic door opening system having safety means and automatic stopping means, as explained above. The door locking and manual door opening mechanisms will be first described.

Referring to FIGS. 6 and 7, first and second locking members 124, 126 have respectively downward and upwardly directed hook portions 128, 130 extending through holes 48, 50 (FIG. 6) of the back plate 52 of the door 16 and bearing portions supported rotatably around support shafts 132, 134 fixed to the door 16. The first locking member 124 also has an extended portion 138, proximate which portion 138 a cantilever 140 is disposed for rotation around shaft 142 which is fixed to the door 16. One upper end of cantilever 140 is disposed between the shaft 36 of the door opening button 28 and the extended portion 138 of the first locking member 124 through the hole 64 and the other, lower end of the cantilever 140 is connected rotatably to a link lever 144 by a pin which is fixed to the door 16. The upper end of the link lever 144 is coupled to the first locking member 124 via a tension spring 146 and the other, lower end of the link lever 144 is connected rotatably to the second locking member 126 by a pin. Therefore, when the button 28 is pressed inwardly against the pressure of the compression spring 40, as indicated by arrow C in FIG. 6, the cantilever 140 is pushed by the shaft 36 and rotated clockise. By this clockwise rotation of the cantilever 140, the first locking member 124 is rotated counterclockwise and the second locking member 126 is rotated clockwise. When the button 28 is returned to its initial extended position, as above, locking members 124, 126 and lever 140 are also all returned to their initial positions (FIG. 6) by the spring 146.

As shown in FIG. 6, when the door 16 is closed, the first and second locking members 124, 126 are engaged with first and second engaging members 148, 150 respectively to lock the door 16 in its closed position. Each of the engaging members 148, 150 is fixed on a support plate 152 by screws, which support plate 152 is fixed in the housing 12. The engaging members 148, 150 have respectively upwardly and downwardly slanted engaging positions 154, 156 which engage with the hook portions 128, 130 of the locking members 124, 126 and shield portions as described above to cover holes formed in the front panel 24 of the housing 12 and the support plate 152, which shields permit the intrusion of the locking members 124, 126 and prevent the escape of microwaves. Openings 158, 160 are formed between the engaging portions 154, 156 and the shield portions for permitting the intrusion of the hook portion 128, 130 of the locking members 124, 126. As is apparent from the foregoing, the engaging members 148, 150 and locking members 124, 126 are included in the door locking mechanism and the door opening button 28 and levers 140, 144 are included in the manual door opening mechanism. When the door 16 is pushed to close the cooking cavity 14, the locking members 124, 126 intrude into the housing 12 through appropriately-placed holes and the hook portions 128, 130 are moved upward and downward respectively along the respective slanted upper and lower surfaces of the engaging portions 154, 156 of the engaging members 148, 150 and, finally, the hook portions 128, 130 are moved downwardly and upwardly respectively by the spring 146 to engage with the engaging portions 154, 156 through the openings 158, 160. By this operation, the door 16 is locked in its fully closed position. When the door opening button 28 is pressed in the direction of arrow C (FIG. 6) to open the door 16, as stated above, the locking members 124, 126 are moved upward and downward respectively to the position shown in FIG. 7 and the engagement of the locking members 124, 126 and engaging members 148, 150 is released. Thereafter, if the user pulls the handle 18 after pressing the button 28, the door 16 may be opened.

As stated above, the appliance further includes an automatic door opening system. The system includes, for example, a foot switch 26 (FIG. 1), a plunger solenoid 162 and two movable members 164, 166 and is constructed so that when the foot switch 26 is pressed, the solenoid 162 is energized to move the movable members 164, 166 which operate to release the engagement of the locking members 124, 126 and the engaging members 148, 150 to unlock the door 16.

The system also includes safety members for stopping the generation of microwaves when the door is opened and automatic stopping means for automatically de-energizing the solenoid when the door is opened even if the foot switch is pressed repeatedly after the door is opened. Referring now to FIGS. 6 and 7, the safety system will be described in detail. A push-type plunger solenoid 162 is mounted on the support plate 152. The solenoid 162 is used for releasing the engagement of two locking members 124, 126 and two engaging members 148, 150 simultaneously. The solenoid 162 is energized to move its plunger 168 to the left in a push-direction shown by arrow D in FIG. 6 when the foot switch 26 is pressed. The support plate 152 also has generally "L" shaped rotation levers 170, 172. The levers 170, 172 are mounted for rotation around shafts 174, 176 fixed to the support plate 152 and disposed so that the solenoid 162 is positioned on a line intermediate between the shafts 174 and 176. One end of each of rotation levers 170, 172 is connected rotatably and slidably to each other by a pin on the lever 170 mating with an elongated hole formed in the lever 172. The mated ends of the rotation levers are coupled to the left end of the plunger 168 via a tension spring 178. The other ends of the rotation levers are connected rotatably and slidably to slide levers 180, 182 respectively by pins on the slide levers mating with elongated holes formed in the rotation levers. The left-most end of the rotation lever 170 is coupled to the support plate 152 via a tension spring 184. The slide levers 180, 182 are supported slidably on the support plate 152 by the mating of pins 186, 188, 190 fixed thereto, mating with elongated holes formed in the slide levers. When the plunger 168 is moved in the direction shown by arrow D in FIG. 6 in response to the operation of the solenoid 162, the first rotation lever 170 is rotated clockwise and the second rotation lever 172 is rotated counterclockwise. By the rotation movement of the levers 170, 172, the first slide lever 180 is moved upward and the second slide lever 182 is moved downward. As is apparent from FIG. 6, the overlapping, central ends of the slide levers 180, 182 are stacked on each other and supported by one pin 188. The other, upper and lower ends of the slide levers 180, 182 contact the outer, left-most ends of movable members 164, 166 respectively. The other, right-most ends of the movable members 164, 166 are mounted rotatably around shafts 192, 194 both of which are respectively fixed to the support plate 152. The upper movable member 164 is urged into contact with the first locking member 124 by a tension spring 196 connected between the support plate 152 and near the unmounted end of the movable member 164. The lower movable member 166 is urged into contact with the second locking member 126 by a tension spring 198 connected between the support plate 152 and near the unmounted end of the movable member 166. Therefore, when the door 16 is locked in its closed position, if the foot switch 26 is pressed to open the door 16, the solenoid 162 is energized to move plunger 168 in the direction shown by arrow D in FIG. 6. The movement of the plunger 168 is transferred to the rotation levers 170, 172 via the spring 178 and the rotation levers 170, 172 are rotated clockwise and counterclockwise respectively. By rotation of the first rotation lever 170, the first slide lever 180 is moved upward to rotate the first movable member 164 clockwise as shown in FIG. 6. By the rotation of the second rotation lever 172, the second slide lever 182 is moved downward to rotate the second movable member 166 counterclockwise as shown in FIG. 7. By the movement of the movable members 164, 166, as described, the locking members 124, 126 are moved upwardly and downwardly respectively and the engagement of the locking members 124, 126 and engaging members 148, 150 is released simultaneously, as shown in FIG. 7. As a result, the door 16 is automatically opened, as stated above.

The over of the second embodiment also has safety means for automatically stopping the generation of microwaves when the door 16 is opened. The safety means includes three safety switches 200, 202 and 204 interlocked with one another, which switches are used for interrupting a power supply to the magnetron and provided pursuant to applicable Department of Health and Human Service and Underwriter's Laboratory standards. Safety switches 200, 202 are disposed side by side on the support plate 152 so as to be contactable by the second movable member 166. Safety switch 204 is also disposed on the support plate 152 but so as to be contactable by the first movable member 164. The safety switches 200, 202, 204 detect whether the door 16 is opened or not and operate to prevent erroneous cooking operation of the microwave oven when the door 16 is open. When the door 16 is in its closed position, the safety switches 200, 202, 204 are pushed by the locking members 124, 126 through coaction with the movable members 164, 166 respectively and are rendered conductive. In this case, normal cooking operation by microwave energy is possible. On the other hand, when the door 16 is opened, the movable members 164, 166 are in contact with the cover portions of the engaging members 148, 150 being urged to that position by the springs 196, 198 and are positioned as shown in FIG. 7 away from the safety switches. Thus, the safety switches are rendered non-conductive and the microwave energy is automatically eliminated. Therefore, the safety means improves the degree of safety of the microwave oven.

As stated above, the automatic stopping means, which automatically de-energizes the solenoid 162 when the door 16 is opened, is also shown in the embodiment of the oven of FIGS. 6 and 7. The stopping means includes a monitoring switch 206 for sensing whether the door 16 is in the open or closed position. The monitoring switch 206 is mounted on the side of the safety switch 204 on the support plate 152. When the door 16 is in the closed position, the monitoring switch 206 is pushed by the first locking member 124 through the first movable member 164 and is rendered conductive. On the other hand, when the door 16 is opened, the movable member 164 is in contact with the cover portion of the engaging member 148 and is positioned as shown in FIG. 7 and thus the monitoring switch 206 is rendered non-conductive. The monitoring switch is inserted in the power supply circuit of the solenoid 162. A power supply circuit for the solenoid 162 is the same as that shown in FIG. 5. Operation of such power supply circuit may be understood by replacing the reference number "112" and "96" of FIG. 5 with "206" and "162", respectively. Therefore, the solenoid 162 is operable only when the monitoring switch 206 is closed (the door 16 is closed). After the solenoid 162 is de-energized, the plunger 168 is returned to its initial position (FIG. 6) by the spring 178. The spring 178 also functions as a shock absorber. That is, even if very high impact results from operation of solenoid 162, the impact is alleviated by the spring 178 to protect various components in the door opening mechanism from a breakdown.

While the foot switch 26 is used for automatically opening the door in the above-mentioned embodiments, the switch 26 could be replaced by a switch provided on the outer surface of the housing 12 so that the user can touch the switch by his body; or a wireless control switch using radio waves instead of wire may be used; or a voice operation switch may be used which operates in response to voice. Furthermore, the solenoid 96 or 162 used as a drive means could be replaced by a motor or the combination structure of a motor and a cam plate. The automatic door opening system could also be applied to various heating appliances such as a gas oven, an electric oven and an electric furnace and not just to the microwave oven described herein.

While specific embodiments of the invention have been illustrated and described herein, it is realized that other modifications and changes, for example, use of a wireless control switch instead of a wired control switch of control means; or replacing a plunger solenoid with a drive means having a combination structure of a motor and a cam plate, will occur to those skilled in the art. It is therefore to be understood that the appended claims are intended to cover all modifications and changes as fall within the true spirit and scope of the invention.

What is claimed is:

1. A door opening apparatus for a heating appliance comprising:

a housing having a heating cavity therein, said heating cavity having an opening;

a door supported on said housing for selectively opening and closing said heating cavity;

at least one locking member disposed in said door;

at least one engaging member disposed in said housing to be engaged with said locking member to lock the door in its closed position;

at least one releasing member for releasing the engagement of said locking member and engaging member to unlock the door;

drive means disposed for moving said releasing member to open the door;

actuating means disposed outside of the housing for actuating said drive means in response to the operation of said actuating means;

at least one safety switch disposed proximate said releasing member for stopping the heating operation of said appliance when the door is opened, said releasing member being spaced from said safety switch when the door is in the open position so that the heating operation of the appliance is prevented and being brought in contact with the safety switch to change the condition of the switch when the door is closed so that the heating operation of the appliance can be initiated; and at least one stop switch for stopping the operation of the drive means when the door is opened, whereby once the door is opened by the operation of the drive means, the drive means and the appliance are rendered inoperative.

2. The apparatus according to claim 1, wherein said drive means includes a plunger solenoid and a power supply circuit to supply a power voltage thereto.

3. The apparatus according to claim 2, wherein said control means includes a switch connected to the drive means by wires.

4. The apparatus according to claim 3, wherein said switch is a foot switch.

5. The apparatus according to claim 1, further comprising spring means for coupling said drive means to said releasing member.

6. A door opening apparatus for a heating appliance comprising:

a housing having a heating cavity therein, said heating cavity having an opening;

a door supported on said housing for selectively opening and closing said heating cavity;

at least one locking member disposed in the door;

at least one engaging member disposed in the housing to be engaged with said locking member to lock the door in its closed position;

at least one releasing member for releasing the engagement of said locking member and engaging member to unlock the door;

a plunger solenoid for moving said releasing member;

a power supply circuit to supply a power voltage to said plunger solenoid;

a foot switch disposed outside of the housing and connected to said power supply circuit to supply said power voltage in response to the operation of said switch;

at least one safety switch disposed proximate said releasing member for stopping the heating operation of said appliance when the door is opened, said releasing member being spaced from said safety switch when the door is in the open position so that the heating operation of the appliance is prevented and being brought in contact with the safety switch to change the condition of the switch when the door is closed so that the heating operation of the appliance can be initiated;

at least one stop switch for stopping the operation of the plunger solenoid when the door is opened; and at least one spring for coupling said plunger solenoid and said releasing member, whereby once the door is opened by the operation of the plunger solenoid, the solenoid and the appliance are rendered inoperative.

7. A door opening apparatus for a microwave oven comprising:

a housing having a heating cavity therein, said heating cavity having an opening:

a door supported on said housing for selectively opening and closing said heating cavity;

at least one locking member disposed in the door;

at least one engaging member disposed in the housing to be engaged with said locking member to lock the door in its closed position;

at least one releasing member for releasing the engagement of said locking member and engaging member to unlock the door;

a door opening button mounted on the door for moving said releasing member when said button is depressed;

a plunger solenoid for moving said releasing member when said solenoid is activated;

a power supply circuit to supply a power voltage to said plunger solenoid;

a foot switch disposed outside of the housing and connected to said power supply circuit to supply said power voltage to operate the plunger solenoid in response to the depression of said foot switch;

at least one safety switch disposed proximate said releasing member for stopping a heating operation of said appliance when the door is opened, said releasing member being spaced from said safety switch when the door is in the open position so that the heating operation of the appliance is stopped and being brought into contact with the safety switch to change the condition of the switch when the door is closed so that the heating operation of the appliance can be initiated;

at least one stop switch for stopping the operation of the plunger solenoid when the door is opened; and at least one spring for coupling said plunger solenoid and said releasing member, whereby the door may be selectively opened either manually or automatically and once the door is opened, the solenoid is inoperative even if the foot switch is depressed.

* * * * *